US009506264B1

(12) United States Patent
Hyman

(10) Patent No.: US 9,506,264 B1
(45) Date of Patent: Nov. 29, 2016

(54) RAMPED GARAGE DRAINAGE SYSTEM

(71) Applicant: Melvin Hyman, Middlebury, IN (US)

(72) Inventor: Melvin Hyman, Middlebury, IN (US)

( * ) Notice: Subject to any disclaimer, the term of this patent is extended or adjusted under 35 U.S.C. 154(b) by 0 days.

(21) Appl. No.: 14/859,511

(22) Filed: Sep. 21, 2015

(51) Int. Cl.
*E04F 15/00* (2006.01)
*E04H 6/42* (2006.01)

(52) U.S. Cl.
CPC ..... *E04H 6/428* (2013.01)

(58) Field of Classification Search
CPC ..... B65G 69/28; B65G 69/30
USPC ..... 14/69.5
See application file for complete search history.

(56) References Cited

U.S. PATENT DOCUMENTS 4,246,982 A * 1/1981 Pretnick ..... F16N 31/004 180/69.1
5,478,625 A * 12/1995 Wright ..... F16N 31/006 180/69.1
5,556,692 A * 9/1996 Zheng ..... E04H 6/424 184/106
5,598,594 A * 2/1997 Milliken ..... B08B 17/00 14/69.5
5,916,658 A * 6/1999 Mohr ..... F16N 31/006 180/69.1
6,120,876 A * 9/2000 Walton ..... F16N 31/006 180/69.1
6,258,430 B1 * 7/2001 Perlman ..... E04H 6/428 180/69.1
6,301,848 B1 * 10/2001 Whitaker ..... B08B 17/00 184/106
6,675,422 B1 * 1/2004 Kuykendall ..... E01C 11/222 14/69.5
7,003,836 B2 * 2/2006 Berg ..... B66F 7/243 14/69.5
7,021,237 B1 * 4/2006 Benjamin ..... E04H 6/426 116/28 R
D672,993 S * 12/2012 Bonahoom ..... D6/592
D729,462 S * 5/2015 Jakubowski ..... D30/199
9,074,332 B1 * 7/2015 Matteson ..... E04H 6/428
2003/0148071 A1 * 8/2003 Sneed ..... F16N 31/006 428/157
2008/0105215 A1 * 5/2008 Simpson ..... A01K 1/0272 119/849
2015/0375983 A1 * 12/2015 Code ..... F16N 31/006 137/312
2016/0032605 A1 * 2/2016 Hosmer ..... E04H 6/428 52/173.1

* cited by examiner

*Primary Examiner* — Thomas B Will
*Assistant Examiner* — Katherine Chu
(74) *Attorney, Agent, or Firm* — Botkin & Hall, LLP

(57) ABSTRACT

A ramped garage draining system is provided having a parking area that is designed to receive a vehicle or other moveable object that may drip liquids. The draining system is designed to reside inside a garage or other structure and direct the liquid outside of the structure. The parking area is bordered on three sides with walls that extend above the parking area to contain the fluids. The ramp slopes toward a draining portion to direct the liquid towards a seal in the door to the structure. Seal interrupters extend under the seal and displace the seal upwards, creating a gap for the liquid to drain.

6 Claims, 6 Drawing Sheets

RAMPED GARAGE DRAINAGE SYSTEM

BACKGROUND OF THE INVENTION

This present disclosure relates to drainage devices, specifically ones that are used to manage snow melt and other common drippings that fall off of a vehicle. In the winter months, snow, slush, ice, and mud commonly build up in the wheel wells and underneath a vehicle. When the vehicle is then parked inside, it is common for some or all of that buildup to drip from the vehicle. These drippings leave puddles that can then become a slipping hazard. Further, some garage floors are not properly slanted towards the door or a drain, causing the drippings to pool or migrate towards interior walls or shared foundation walls. Other drainage devices on the market attempt to solve this problem, commonly by damming off the area the vehicle is parked on. These devices create another problem: how to deal with the pooled water, slush, and dirt mix. Some require pumping while others require an external drain hose. Some devices provide no means to be drained and expect that normal evaporation will take care of the mess. Others provide a natural drain, but all drippings remain in the garage, constructively leaving the problem unsolved. An improved garage draining device is necessary.

SUMMARY OF THE INVENTION

The present disclosure describes a garage floor system and vehicle dripping management device that allows for automatic drainage of liquids from a vehicle or other rolling device that can have snow melt or other liquids drip therefrom. The device has an area where the vehicle is parked and is ramped so that dripping liquids flow towards one end of the device. The area is bounded by three walls that protrude above the parking area and serve to contain any liquids that drip onto the area. The device has a draining area that extends from the side that is not bounded that receives drainage from the parking area. The draining area spans a threshold between the outside and interior of the garage. The area has a portion that protrudes above the surface to displace a portion of the garage door seal, allowing any liquid to flow underneath the door and out of the garage interior. Due to the arrangement of the sides and the draining area, any drippings from the vehicle can only drain through the gap created between the garage door seal and the protrusion on the draining area.

BRIEF DESCRIPTION OF THE DRAWINGS

A preferred embodiment of this invention has been chosen wherein.

DESCRIPTION OF THE PREFERRED EMBODIMENT

Figure 1:
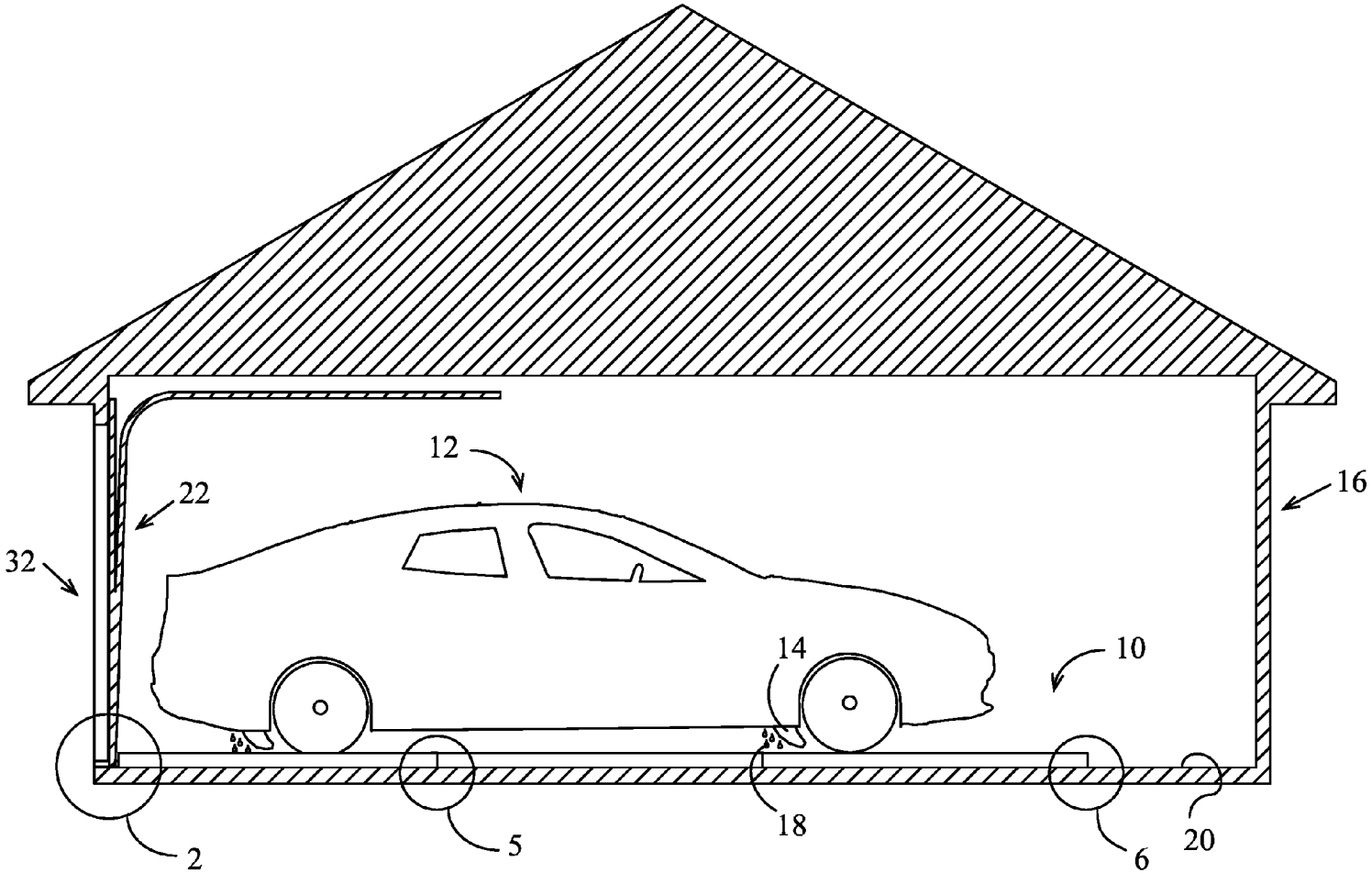
FIG. 1 is a side view of the device as used in a typical household garage.

A garage draining device 10 as shown in FIG. 1 is used to store a parked vehicle 12. In cold weather where snow and ice is common, buildup 14 underneath the vehicle and in the wheel wells is commonplace. Frequently the temperature inside the garage 16 is above the melting point of the buildup 14, causing it to drip 18 from the vehicle 12. The floor 20 of the garage 16 as shown in FIG. 1 is a flat surface that will not naturally cause liquid to drain towards the garage door 22.

Figure 2:
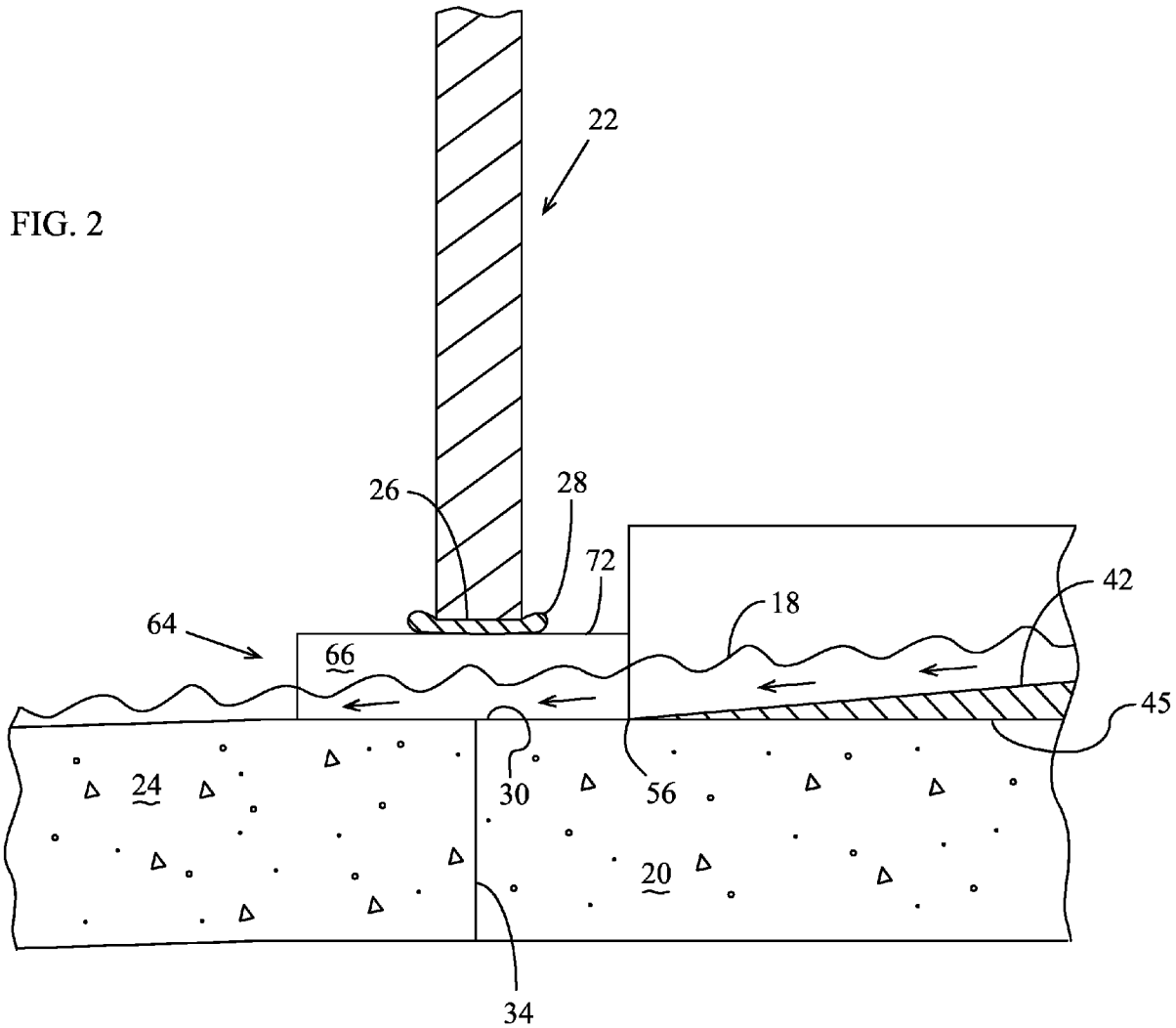
FIG. 2 is a partial section view of the leading edge of the device as shown in FIG. 1.

As is shown in FIG. 2, the floor 20 extends out underneath the garage door 22, where it meets a driveway 24 or other surface that is located outside of the garage 16. It is contemplated that the floor 20 stops short of the door 22 or stops directly underneath it. It is further contemplated that the floor 20 is continuous from inside the garage 16 to the outside of the garage 16. At the bottom edge 26 of the door 22 is a gasket 28 that serves to seal the door 22 to the upper surface 30 of the garage floor 20. The garage door 22 is affixed to the wall of the garage 16 adjacent to an opening 32 as shown in FIG. 1. The garage door 22, as known in the art, opens and closes either manually or with an automatic opener. As shown, the garage door 22 is segmented and travels on a track between the closed and opened position. The garage door 22, when closed, contacts the threshold 34 which is a boundary between the interior and exterior of the garage 16.

Figure 5:
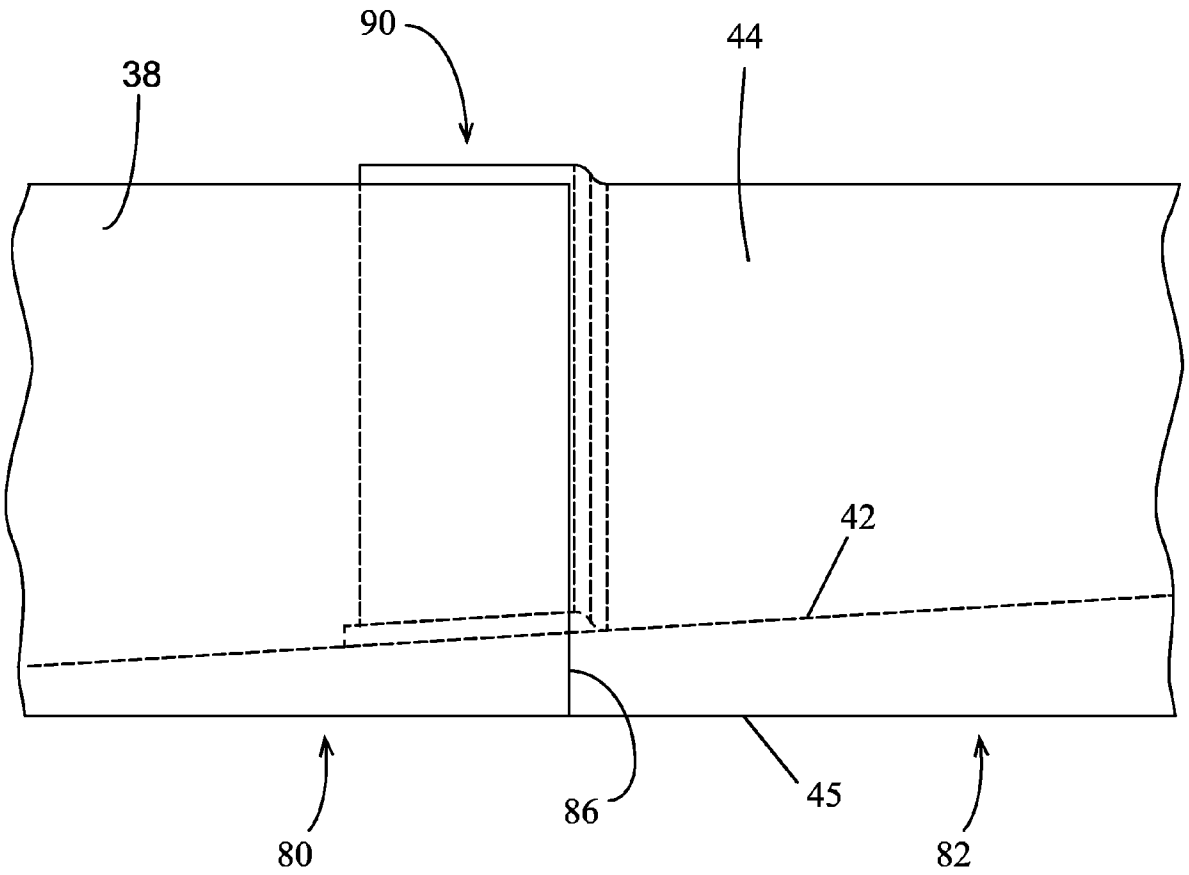
FIG. 5 is a side view 5 of the device as shown in FIG. 1.
Figure 6:
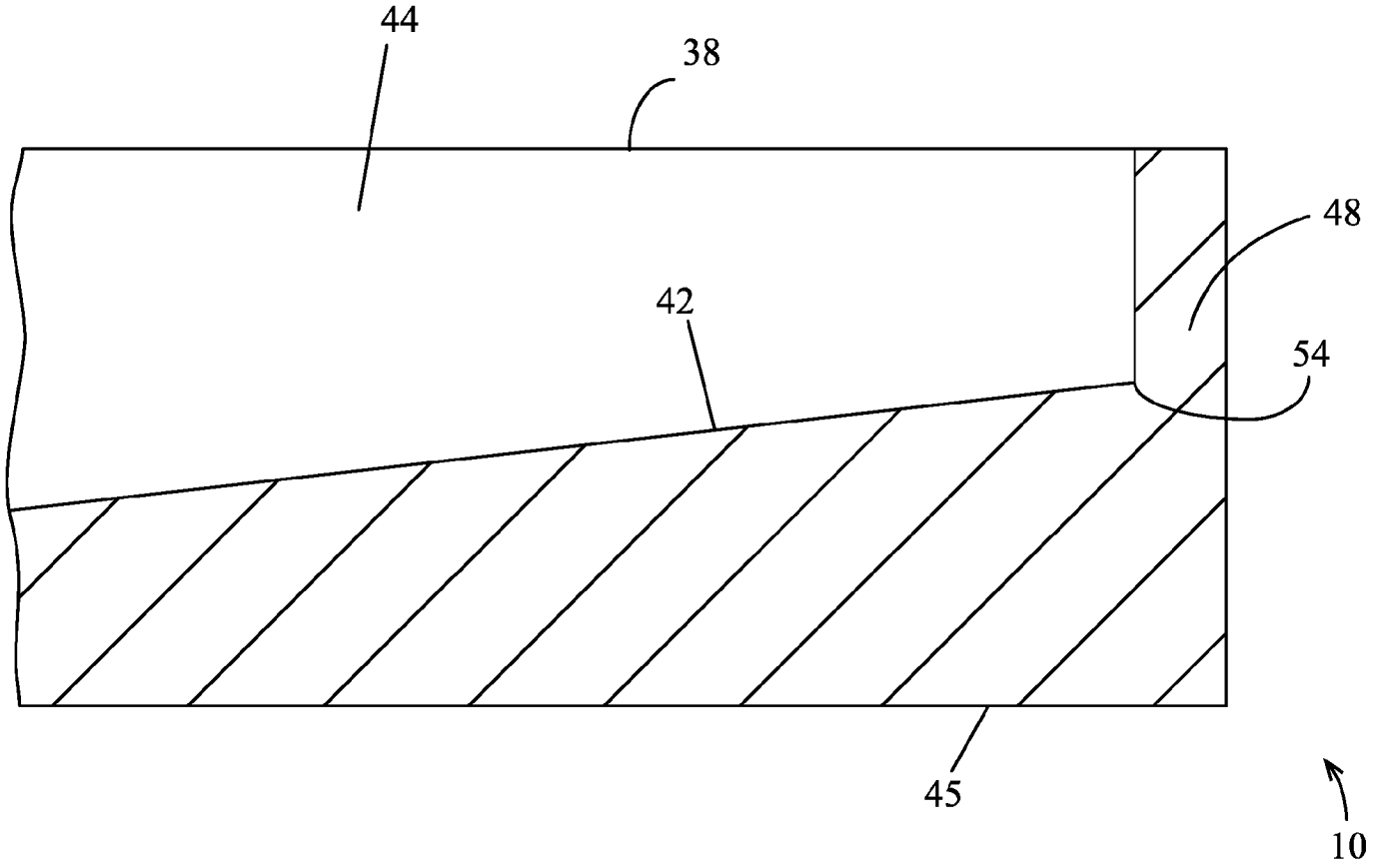
FIG. 6 is a side section view 6 of the device as shown in FIG. 1.

The device 10 as shown in FIG. 2 has a parking area 40 that has an upper surface 42 and a lower surface 45. As shown, the upper surface 42 is flat and ramped with respect to the lower surface 45. It is contemplated that the upper surface 42 has an anti-slip coating for safety. The lower surface 45 rests on the upper surface 30 of the garage floor 20. Surrounding three sides of the parking area 40 are lateral walls 44, 46 and a terminal wall 48 that protrude above the upper surface 42. The walls 44, 46, and 48 form a barrier to liquid that prevent it from leaving the upper surface 42. Where the lateral walls 44, 46 meet the upper surface 42, lateral edges 50, 52 are formed. Correspondingly, a terminal edge 54 is formed where the terminal wall 48 meets the upper surface 42. As shown in FIG. 5, the top 38 of the lateral wall 44 is parallel to the lower surface 45. It is contemplated that the top 38 of the lateral wall 44 and the top of the other lateral wall 46 remain parallel to the upper surface 42. It is further contemplated that the lateral walls 44, 46 and terminal wall 48 are integral with the parking area 40 to form a continuous sealed surface.

Figure 4:
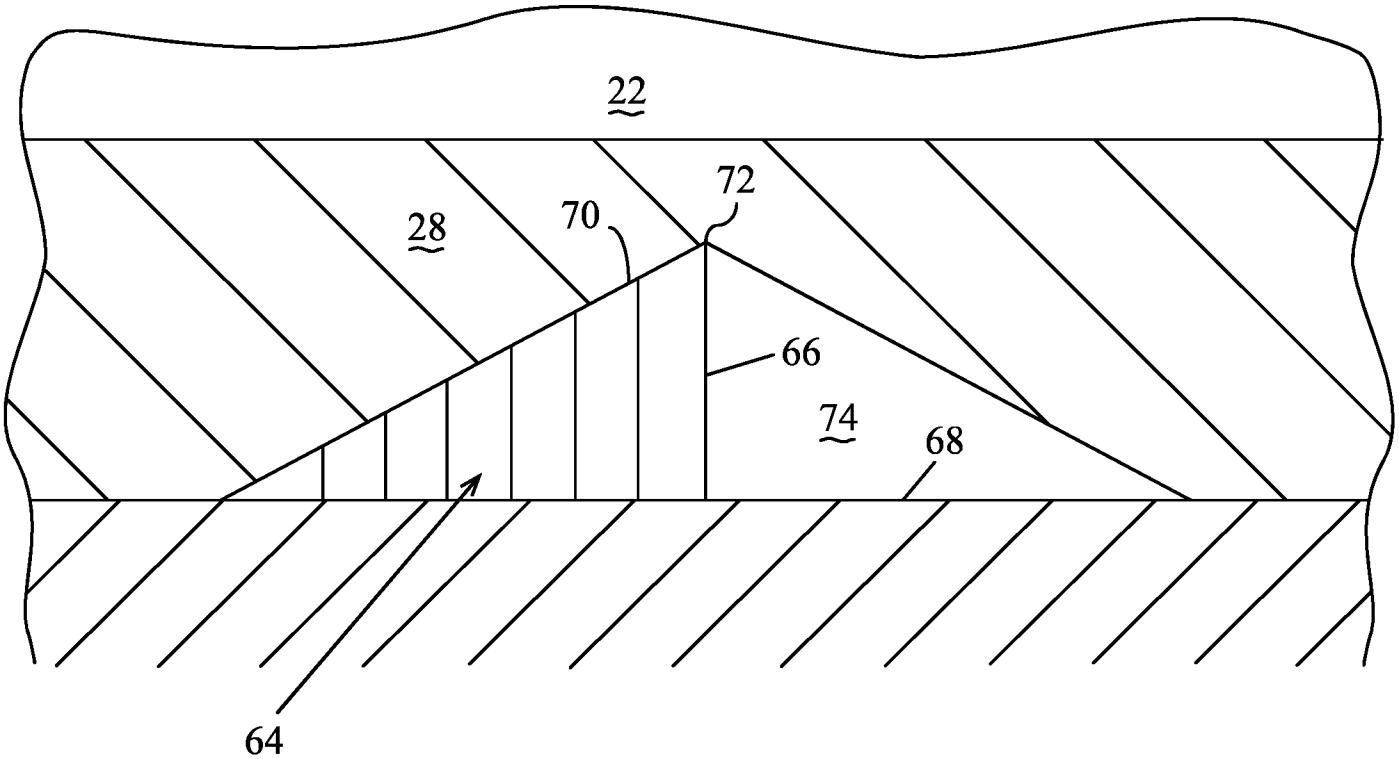
FIG. 4 is a front section view 4 of the device as shown in FIG. 3.

A leading edge 56 of the parking area 40 is located opposite the terminal edge 54 that defines the entry point for the vehicle 12. All liquid that drains from the device 10 passes over the leading edge 56. Extending outwardly from the parking area 40 at the leading edge 56 is a draining portion 60. The draining portion 60 may have mounting holes 78 to affix the device 10 to the floor 20, threshold 34, or driveway 24. The draining portion 60 extends beyond the length of the leading edge 56 and can be at least as wide as outside surfaces of the lateral walls 44, 46. The lateral walls 44 and 46 do not protrude into the draining portion 60. The draining portion 60 has a leading edge 62 and has seal interrupters 64 at the ends near the lateral walls 44, 46. The seal interrupters 64 extend from the leading edge 62 to the leading edge 56. As shown, the device 10 has two seal interrupters 64, but it is contemplated that other quantities of seal interrupters 64 are used. As installed, the seal interrupters 64 extend from the inside of the garage 16 to the outside and cross the threshold 34. The seal interrupter 64 as shown in FIGS. 2 and 4 has a surface 66 that extends upwardly from an upper surface 68 of the draining portion 60. An angled surface 70 extends upwardly from the upper surface 68 and meets at a top edge 72. As shown in FIG. 4, when the garage door 22 is down, the gasket 28 is displaced upward and away from the upper surface 68 by the top edge 72 and angled surface 70. The displaced area or gap 74 is located adjacent to the surface 66. It is contemplated that the surface 66 is not vertical, but it does need to be shaped to create the gap 74 to properly function. A gradual slope or radius for surface 66 would not displace the seal sufficiently to create the gap 74.

As drippings 18 fall from the vehicle 12, they begin to collect and run down the upper surface 42 of the parking area 40. The terminal wall 48 and lateral walls 44, 46 prevent any drippings 18 from escaping the portion of the device 10 that is located inside the garage 16. Due to the ramped upper surface 42, the drippings 18 move towards the leading edge 56. The drippings 18 then cross the leading edge 56 of the parking area 40 and onto the draining portion 60. If the garage door 22 is down, the drippings 18 may contact the gasket 28 and then move towards one of the seal interrupters 64. Once it reaches the gap 74, gravity allows it to drain across the threshold 34 and out of the garage 16. The leading edge 62 of the draining portion 60 is the lowest on the device 10 to allow for proper draining. It is contemplated that the draining portion 60 may be slightly taller in the middle and curved downward towards the seal interrupter 64 to help channel any drippings 18 toward the gap 74. The primary feature of the device 10 is that the drippings 18 can only pass under the garage door 22 adjacent to the seal interrupter 64.

As is shown in FIG. 5, the device 10 can be an assembly of multiple parts to allow economical shipping and storage. The parking area 40 and lateral walls 44, 46 are separated into several parts such as parts 80, 82, and 84. They meet at the seams 86, 88 because the parking area 40 must channel drippings 18 toward the draining portion 60, the portions 80 and 82 must mate securely and be water-tight. As shown in FIG. 5, a portion of the upper surface of part 82 overlays a portion of the upper surface of part 80 in an overlap area 90. This allows drippings 18 to travel over the part 82 to part 80. The upper surface 42 can include a flexible membrane or be sealed as part of the assembly. It is contemplated that the parts 80, 82, and 84 abut at the seams 86, 88 without the overlap area 90 and seal on the abutted seams.

Figure 3:
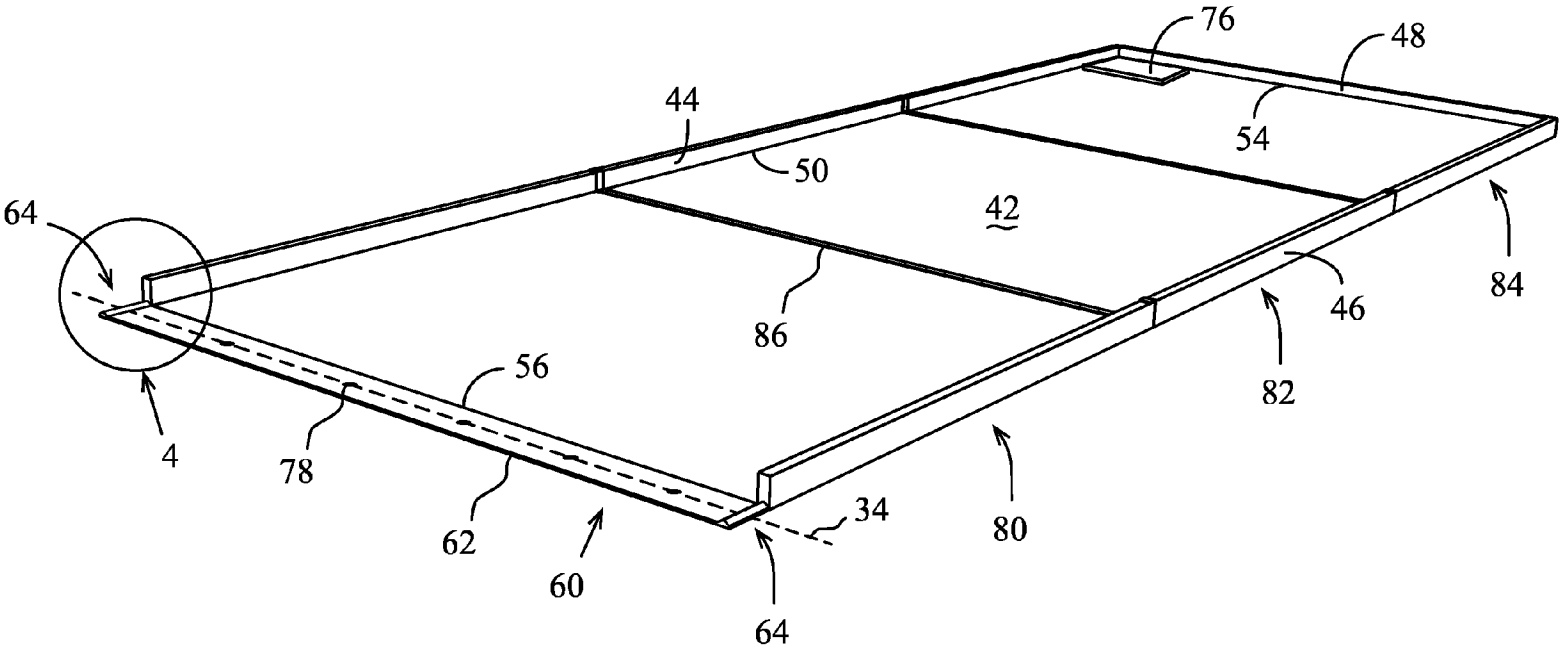
FIG. 3 is a perspective view of the device.

As shown in FIG. 3, a parking stop 76 can be added to provide the user feedback when they are properly parked on the device 10. The parking stop 76, as shown, rests in one or both corners of the parking area 40 where a portion of it abuts the terminal wall 48 and one of the lateral walls 44, 46. Different sizes and shapes of the parking stop 76 can be switched out for different sized vehicles. One of the goals of the parking stop 76 is to prevent the front of the vehicle 12 from extending beyond the terminal wall 48, thereby keeping all drippings 18 on the parking area 40 and off of the floor 20.

Because drainage occurs near the ends of the draining portion 60, it is contemplated that the draining portion 60 has channels that allow additional draining. The channels (not shown) are thinner areas in the draining portion 60 that are narrow enough to prevent the gasket 28 from extending downwardly and blocking them off. The channels allow drainage in addition from the seal interrupters 64.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A draining system in combination with an enclosed area separate from said draining system, said enclosed area having a floor, upstanding walls, and an aperture through one of said walls in said enclosed area, said aperture having a door being vertically moveable between an open position and a closed position to obstruct said aperture, said door having a bottom edge with a resilient seal, said seal being relatively close to said floor and contacting seal interrupters in said closed position, said seal being relative far from said floor in said open position, said floor having a threshold adjacent said aperture and being overlaid by said seal when said door is in said closed position, said threshold defining a boundary between an outside and an inside of said enclosed area, said system comprising:

a parking area adapted to receive a vehicle having a width and length, said parking area having an upper surface and a lower surface, said upper surface having lateral wall portions protruding from said upper surface in a direction opposite said lower surface, each of said lateral wall portions having an inner surface facing said parking area and an outer surface located oppositely thereof and spaced from said inner surface to define a thickness of said lateral wall portions, said lateral wall portions located at lateral edges of said parking area and being spaced apart at a distance wider than said vehicle width, said lateral wall portions terminating at a first end at a terminal wall portion sealingly connected to said lateral wall portions, said terminal wall portion transversely located at a terminal edge of said upper surface and protruding from said upper surface in a direction opposite said lower surface, said parking area having a leading edge opposite said terminal edge and being substantially parallel to said terminal edge, said terminal edge spaced from said leading edge at a distance longer than said vehicle, said lateral wall portions being substantially parallel to each other;

a draining portion having an upper surface and a lower surface, said draining portion overlaying said threshold and having a leading edge located outside said enclosed area, said draining portion terminating at a trailing edge located inside said enclosed area and sealingly affixed to said leading edge of said parking area, said draining portion extending from said leading edge of said parking area;

said seal interrupters located near distal ends of said draining portion and protruding upwardly from said upper surface, said seal interrupters extending from said leading edge of said draining portion to said leading edge of said parking area, each of said seal interrupters having an inward facing surface, said inward facing surface of one of said seal interrupters facing said inward facing surface of another of said seal interrupters, said inward facing surfaces of said seal interrupters being aligned between said inner and outer surfaces of said lateral wall portions;

when said door is in said closed position, a gap is formed adjacent to one of said seal interrupters and between a portion of said upper surface of said draining portion and said seal; and when liquid drains from said vehicle, said liquid travels toward said draining portion and through said gap.

2. The draining system according to claim 1, said upper surface of said parking area being relatively close to said floor near said draining portion, said upper surface of said parking area being relatively far from said floor near said terminal edge.

3. The draining system according to claim 1, each said seal interrupters having an upstanding surface being substantially perpendicular to said upper surface of said draining portion, one of said seal interrupters located at a second distal end of said draining portion, said upstanding surfaces facing each other.

4. The draining system according to claim 1, said draining portion having apertures extending from said upper surface to said lower surface, said apertures adapted to affix said draining system to said floor adjacent said threshold.

5. The draining system according to claim 1, and a transverse seam extending from said outer surface of one of said lateral walls to said outer surface of an opposing said lateral wall, said seam sealably connecting separate portions of said draining system.

6. The draining system according to claim 1, said upper surface of said parking area having a non-slip coating.

* * * * *